US010299545B2

(12) United States Patent
Rowland et al.

(10) Patent No.: US 10,299,545 B2
(45) **Date of Patent: *May 28, 2019**

(54) BELT ADJUSTMENT SYSTEM

(71) Applicants: Edward R. Rowland, Alta Loma, CA (US); Thomas W. Hunsucker, Alta Loma, CA (US)

(72) Inventors: Edward R. Rowland, Alta Loma, CA (US); Thomas W. Hunsucker, Alta Loma, CA (US)

(73) Assignee: Edward R. Rowland and Thomas W. Hunsucker, Alto Loma, CA (US)

( * ) Notice: Subject to any disclaimer, the term of this patent is extended or adjusted under 35 U.S.C. 154(b) by 77 days.

This patent is subject to a terminal disclaimer.

(21) Appl. No.: 15/411,071

(22) Filed: Jan. 20, 2017

(65) Prior Publication Data

US 2017/0258160 A1 Sep. 14, 2017

Related U.S. Application Data

(63) Continuation of application No. 14/580,886, filed on Dec. 23, 2014, now Pat. No. 9,185,942, which is a continuation of application No. 14/227,268, filed on Mar. 27, 2014, now Pat. No. 9,549,581, which is a continuation of application No. 13/210,227, filed on Aug. 15, 2011, now Pat. No. 8,689,364.

(60) Provisional application No. 61/410,759, filed on Nov. 5, 2010, provisional application No. 61/347,184, filed on May 21, 2010.

(51) Int. Cl.

| | |
|---|---|
| ***A44B 11/24*** | (2006.01) |
| ***A44B 11/12*** | (2006.01) |
| ***A41F 9/00*** | (2006.01) |
| *A44B 11/00* | (2006.01) |

(52) U.S. Cl.

CPC ..... *A44B 11/12* (2013.01); *A41F 9/002* (2013.01); *A44B 11/24* (2013.01); *A44B 11/006* (2013.01); *Y10T 29/49826* (2015.01)

(58) Field of Classification Search

CPC ..... A41F 9/002; A41F 11/16; F16L 3/233; A44B 11/24

See application file for complete search history.

(56) References Cited

U.S. PATENT DOCUMENTS

| | | | | |
|---|---|---|---|---|
| 6,067,662 | A * | 5/2000 | Sim | A44B 11/14 2/322 |
| 8,689,364 | B2 * | 4/2014 | Rowland | A41F 9/025 2/311 |
| 9,185,942 | B2 * | 11/2015 | Rowland | A41F 9/025 |
| 9,277,776 | B2 * | 3/2016 | Laatz | A44B 11/125 |
| 9,549,581 | B2 * | 1/2017 | Rowland | A41F 9/025 |
| 2015/0342306 | A1 * | 12/2015 | Chen | A44B 11/006 24/185 |

* cited by examiner

*Primary Examiner* — Tajash D Patel
(74) *Attorney, Agent, or Firm* — Mintz Levin Cohn Ferris Glovsky and Popeo, P.C.

(57) ABSTRACT

Disclosed are belt adjustment systems, particularly for wearing around a user's waist, that permit a continuum of belt loop sizes or a larger selection of belt loop sizes. The belt adjustment system includes an elongate belt member having a first end, a second end and a series of teeth positioned on an inner surface near the second end and a fixation member having first and second adjustment elements.

17 Claims, 8 Drawing Sheets

BELT ADJUSTMENT SYSTEM

CROSS REFERENCE TO RELATED APPLICATIONS

This application is a continuation of U.S. patent application Ser. No. 14/580,886, filed Dec. 23, 2014 (now U.S. Pat. No. 9,185,942), which is a continuation of U.S. patent application Ser. No. 14/227,268, filed Mar. 27, 2014, issuing on Jan. 24, 2017 under U.S. Pat. No. 9,549,581, which is a continuation of U.S. patent application Ser. No. 13/210,227, filed Aug. 15, 2011 (now U.S. Pat. No. 8,689,364), which claimed the benefit of priority of U.S. Provisional Patent Application Ser. Nos. 61/374,184, filed Aug. 16, 2010, and 61/410,759, filed Nov. 5, 2010. Priority of the aforementioned filing dates and the disclosures of the applications are hereby fully incorporated by reference in their entirety.

BACKGROUND

Conventional belt adjustment systems are limited in their ability to conform to a particular user's waist size. Belt adjustment systems conventionally secure a belt about a user's waist by relying on a series of equidistantly-spaced holes punched through an end of a belt. A hook of a belt buckle can be inserted through a hole to capture the end of the belt to secure the belt in a loop of a particular size. The spacing between each of the holes as well as the overall number of holes can vary for adjustment of belt size, but is generally limited by the minimal material that must remain between the holes. Conventional belt adjustment systems are limited to setting the size of the belt loop to discrete sizes based upon the spacing of the holes in the belt. If a user desires to set the belt to a loop size that is positioned between the holes in the belt, the user has to manually create an additional hole in the belt, which can be difficult and unattractive if not performed well. Alternately, the user must use the next smaller or next larger belt loop size relative to the desired size, which can be uncomfortable for the user.

Other belt adjustment systems are known that increase the flexibility of adjustment to a variety of waist sizes, but these adjustment systems are not typically fashionable or aesthetically pleasing.

SUMMARY

There is a need for a belt adjustment system that permits a continuum of belt loop sizes or a larger selection of belt loop sizes. Disclosed herein are clothing accessories, particularly belt adjustment systems for wearing around a user's waist.

In one aspect, disclosed is a belt system including an elongate belt member having a first end, a second end and a series of teeth positioned on an inner surface near the second end and a fixation member. The fixation member includes a first adjustment element having a channel configured to reversibly couple with the first end of the belt member; and a rotating plate forming a surface of the channel and having a plurality of teeth configured to engage the first end of the belt member. The fixation member also includes a second adjustment element coupled to the first adjustment element. The second adjustment element includes a channel extending between an outer portion coupled to an inner span having a magnetic element, the channel configured to receive the second end of the belt member; and a belt engagement mechanism having a pivoting pin element coupled to a plate element having a pawl at a first end and a tab at a second, opposite end. The plate element includes a first position in which the tab is attracted towards the magnetic element and the pawl projects into the channel. The plate element includes a second position in which the tab is urged away from the magnetic element and the pawl rotates away from the channel.

The pin element can further include an actuation button coupled to a first end. Actuating the actuation button can pivot the plate element toward the second position. The elongate belt member can include a series of printed markings on the inner surface near the first end. The series of printed markings can correspond to a plurality of clothing waist sizes. The belt member can be customizable by cutting the first end to size according to a printed marking. The outer portion of the second adjustment element can further include a front panel. The front panel can be coupled to the outer portion by a hinge. The front panel can be configured to rotate away from the outer portion around an axis of the hinge. The hinge can be positioned on a downward-facing side of the second adjustment element and the front panel rotates in a top-down direction. The front panel can be configured to store a removable article. The removable article can be a golf ball marker removably coupled to the front panel by a magnet. The front panel can include a belt insert held within a frame and covering a hook. The belt insert can be formed of a material that matches a material of the belt member. The belt insert can include a notch in a perimeter region through which a portion of the hook is visible. The belt insert and portion of the hook can provide the belt system with an appearance of a conventional belt threaded through a belt buckle.

Other features and advantages should be apparent from the following description of various embodiments, which illustrate, by way of example, the principles of the claimed subject matter.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

Figure 1:
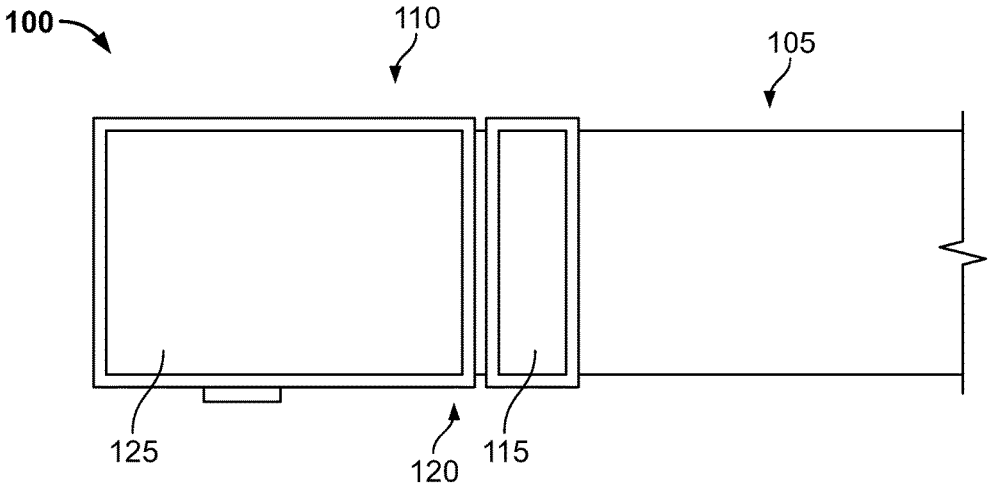
FIG. 1 illustrates a schematic view of an embodiment of a belt system.

FIG. 1 illustrates a schematic view of an embodiment of a belt system 100 that may be worn with a pair of pants, shorts, trousers, skirts or other articles of clothing. The system 100 can also be used with other items such as watch straps, purse straps or animal collars or other articles that may include a buckle system that is adjusted for size or where a number of size variations would be desirable. The figures include exemplary numerical dimensions. It should be appreciated that the dimensions are for example only and are not intended to be limiting. The belt buckle system can be configured with dimensions outside of the ranges and values shown.

The belt system 100 can include an elongate belt member 105 and a fixation member 110 having a first adjustment element 115 coupled via a hinge element 120 to a second adjustment element 125. The fixation member 110 is configured to reversibly couple with the belt member 105. A first end 101 of the belt member 105 can couple with the first adjustment element 115 of the fixation member 110 and an opposite, second end 102 of the belt member 105 can couple with the second adjustment element 125, as will be described in more detail below.

Figure 2:
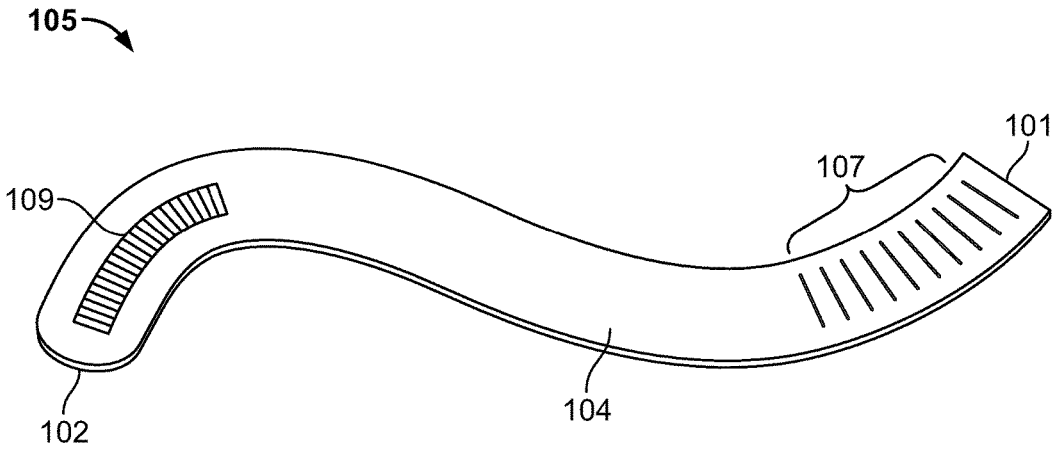
FIG. 2 illustrates a schematic view of an embodiment of a belt member.

The belt member 105 can include an elongate strip of flexible material or materials appropriate for wearing around a user's waist. The belt member 105 can be formed of a variety of materials including leather, fabric, plastic or any other material as is known in the art. As shown in FIG. 2, the inner surface 104 of the belt member 105 can include markings 107 near the first end 101 such that the belt member 105 can be adjusted in length, such as by cutting to achieve a predetermined belt size or waist size. For example, the markings 107 can include printed or stamped graduations that can include a numerical indication of the size of the belt if cut at a particular marker. The markings 107 provide guidance for cutting the belt member 105 to customize the length of the belt member 105 to a user's pant size or waist measurement. The sizing indicated by the markings 107 can vary from at least about 24, 26, 28, 29, 30, 31, 32, 33, 34, 35, 36, 37, 38, 39, 40 or larger pant size. It should be appreciated that any number of various lengths can be indicated by the markings 107, including fraction sizes, men's sizes, women's sizes, boy's sizes, girl's sizes as well as European sizes, U.S. sizes, etc. The user can easily cut to size the belt member 105 to an appropriate size without having to use a separate measuring device. The belt member 105 customization provides the belt system 100 with a one-size-fits-all convenience and an advantage in terms of manufacturing and distribution.

Still with respect to FIG. 2, the inner surface 104 of the belt member 105 can have a series of notches or teeth 109 at the second end 102. The teeth 109 can have a ramped portion facing the second end 102 of belt member 105 and a stepped portion perpendicular to the longitudinal axis of the belt member 105. The teeth 109 can be configured to engage with the second adjustment element 125, as will be described in more detail below, to provide various levels of adjustment of the position of the belt member 105 relative to the second adjustment element 125 that permits a continuum or substantial continuum of loop sizes independent of pre-punched, equidistantly-spaced holes of conventional belts. The teeth 109 can be at least about 8 cm to about 12 cm from the end 102. In some embodiments, the teeth 109 can be positioned at least about 9 cm to about 10 cm from the end 102. Similarly, the spacing and number of teeth 109 in the series can vary as well as the length of the belt member 105 over which the teeth 109 extend. In some embodiments, the spacing of the teeth 109 is at least about ¼" apart.

Figure 3:
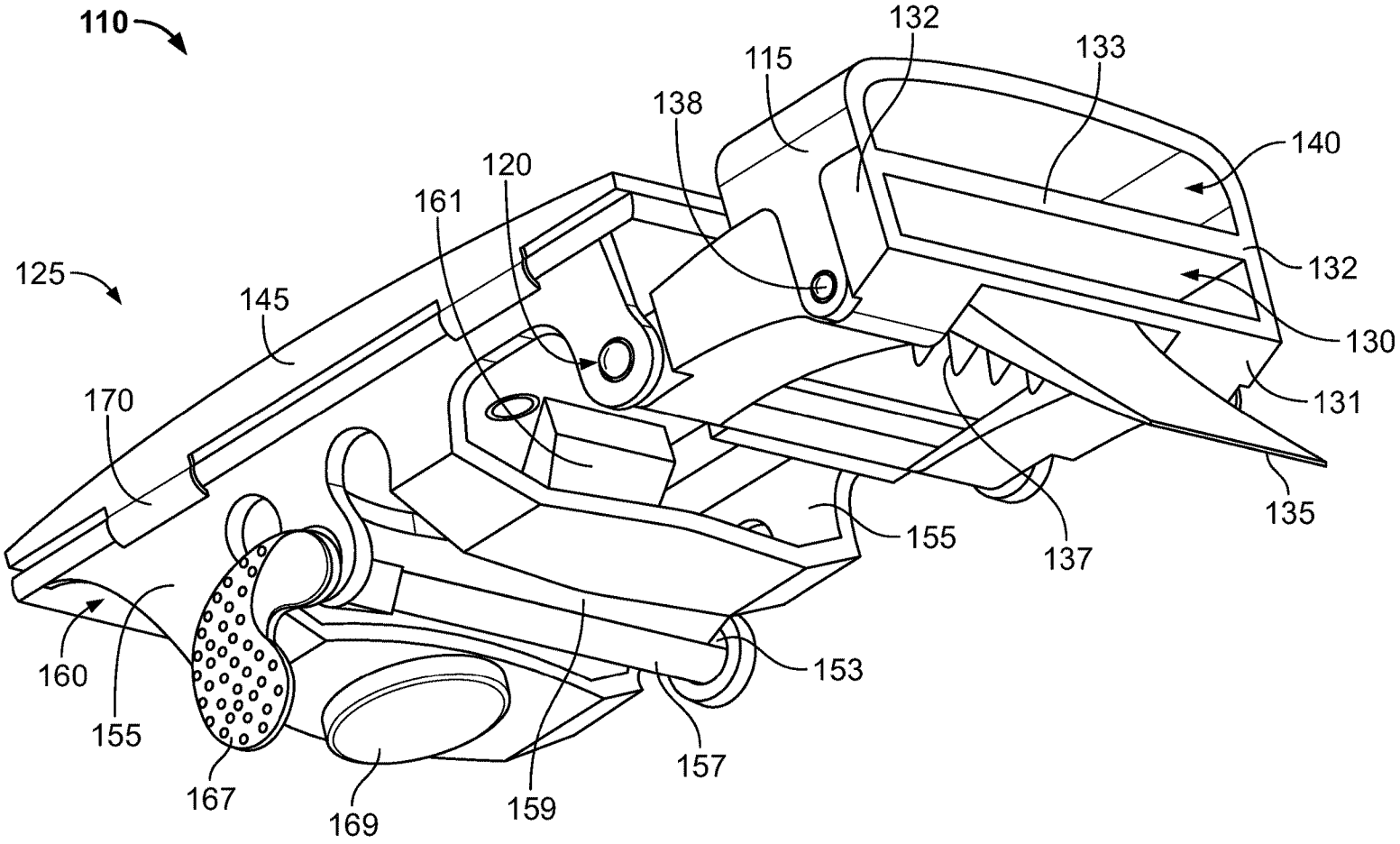
FIG. 3 illustrates a perspective view of an embodiment of a fixation member for a belt system.
Figure 4:
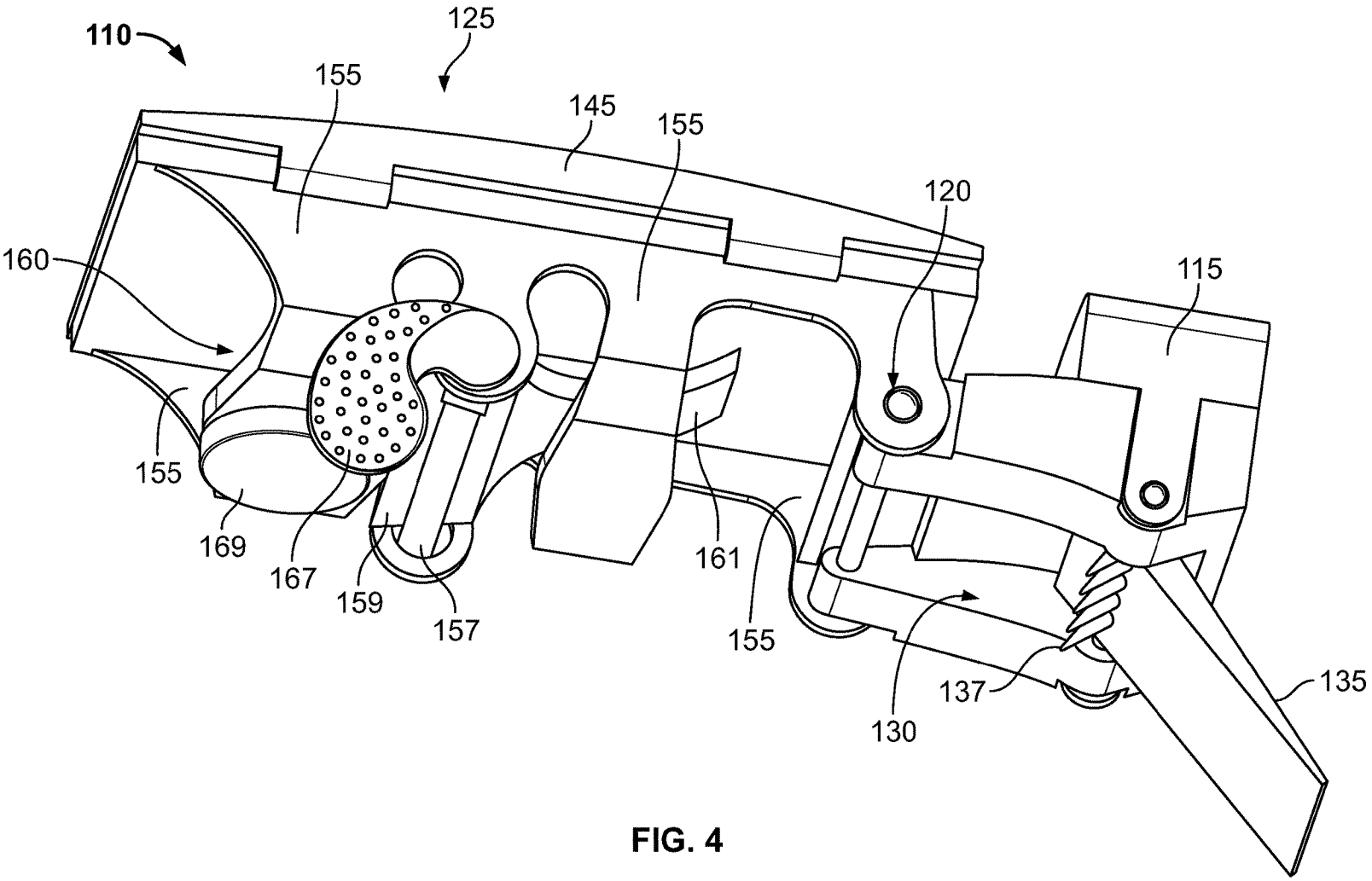
FIG. 4 illustrates another perspective view of the fixation member of FIG. 3.
Figure 5:
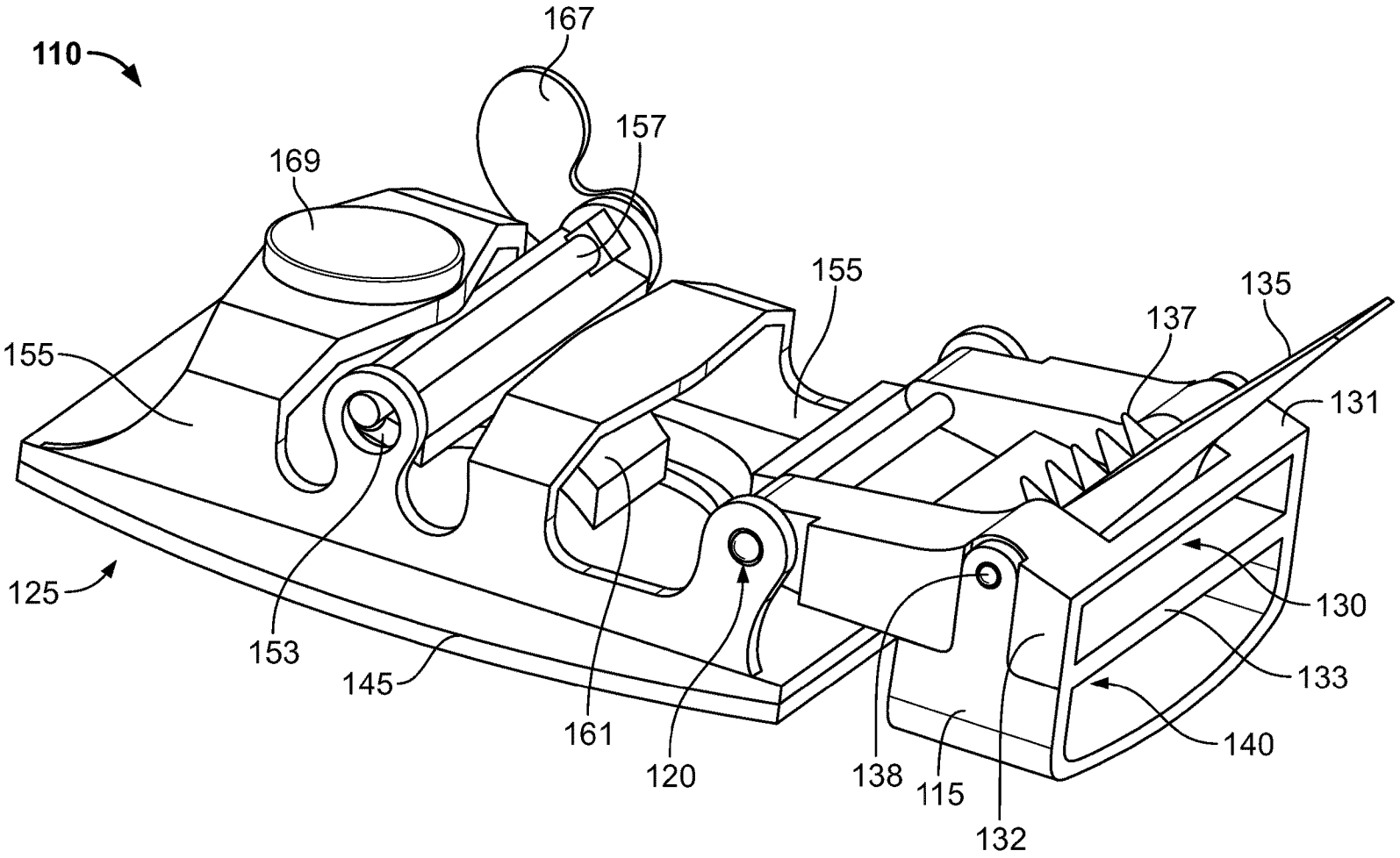
FIG. 5 illustrates another perspective view of the fixation member of FIG. 3.

FIGS. 3, 4 and 5 illustrate an embodiment of a fixation member 110. As mentioned above, the fixation member 110 can have a first adjustment element 115 and a second adjustment element 125. The first adjustment element 115 can couple to the second adjustment element 125 by a hinge element 120 such that elements 115, 125 can rotate freely relative to one another for a more conforming fit around a portion of a user's waist. As will be discussed in more detail below, the first adjustment element 115 can couple with the first end 101 of the belt member 105 and the second adjustment element 125 can couple with the second end 102 of the belt member 105.

As best shown in FIGS. 3 and 5, the first adjustment element 115 can include a channel 130 that is configured to receive the first end 101 of the belt member 105. The channel 130 can be generally rectangular in shape and formed by two sidewalls 132, an outer wall 133 and an inner wall 131. The inner wall 131 of the channel 130 can include a plate member 135 configured to rotate around hinge element 138 from a closed configuration to an open configuration. In the closed configuration, the outer surface of the plate member 135 can be flush with inner wall 131. In the open configuration, the plate member 135 can rotate around hinge element 138 to extend away from the longitudinal axis of the fixation member 110. The plate member 135 can include teeth 137 positioned on an inner surface of the plate member 135 at an end nearest the hinge element 138. When the plate member 135 is in the closed configuration, the teeth 137 can extend into the interior volume of channel 130. The teeth 137 can capture a belt member 105 inserted through the opening and positioned within the channel 130. The teeth 137 upon rotation around the hinge element 138 to the closed configuration can dig into the belt member 105 positioned within the channel 130 and press the belt member 105 against the outer wall 133 of the channel 130. The first adjustment element 115 can also include a second channel 140 positioned above the first channel 130. The second channel 140 can be aligned with a channel 160 extending through the second adjustment element 125 along the longitudinal axis of the fixation member 110 and is configured to receive the second end 102 of the belt member 105 exiting the second adjustment element 125.

Again with respect to FIGS. 3, 4 and 5, the channel 160 of the second adjustment element 125 can be formed by a front panel 145 and one or more inner spans 155 extending across the channel 160. The inner spans 155 can be coupled at each end to a side portion of the front panel 145 and form an inner surface for the second adjustment element 125. When worn, the front panel 145 is positioned away from a user's waist and the inner spans 155 are positioned closest to a user's waist. It should be appreciated that although the inner spans 155 are shown in the figures as being a plurality of spans 155, that the inner surface of the second adjustment element 125 can also be formed by a single, continuous inner span 155 coupled at either end to the front panel and surrounding the channel 160. The second adjustment element 125 can include an opening configured to receive the second end 102 of the belt member 105 such that the belt member 105 can extend through the channel 160 and into channel 140 of the first adjustment element 115.

Figure 6A:
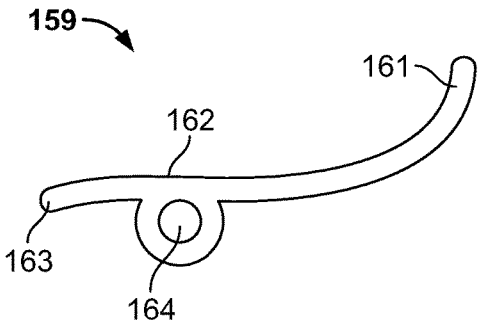
FIGS. 6A and 6B illustrate side and top views, respectively, of an embodiment of a plate element.
Figure 6B:
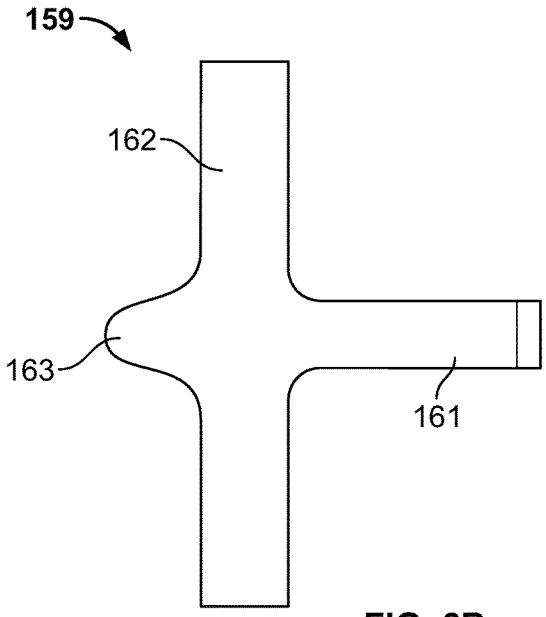

The second adjustment element 125 can include a belt engagement assembly for adjusting and capturing a position of the belt member 105 positioned within the channel 160. The belt engagement assembly can include a pin element 157 coupled to a plate element 159. The pin element 157 can extend through a pair of apertures 153 located in a side region of the inner span 155. As best shown in FIGS. 6A and 6B, the plate element 159 can include a generally planar member 162 having a pawl 161 at a first end and a tab 163 at an opposite end. The pawl 161 can extend away from the plane of the plate element 159 in a first direction and tab 163 can extend away from the plane of the plate element 159 in a second, opposite direction as pawl 161. It should be appreciated that the tab 163 also can be generally aligned with the plane of the plate element 159. The plate element 159 can include a pair of apertures 164 in the lateral regions of the planar member 162. Apertures 164 can align with apertures 153 such that the pin element 157 extends through apertures 164 of the plate element 159 and apertures 153 of the span 155 to couple the plate element 159 to the second adjustment member.

The plate element 159 can toggle between a first, closed position and a second, open position. When the plate element 159 is coupled to the pin element 157, the plate element 159 spans across the channel 160 and tab 163 aligns with a region of the inner span 155. In some embodiments, the region of the inner span 155 can be magnetized such that the tab 163 is attracted to the region and biases the plate element 159 into the closed position in which the pawl 161 extends into channel 160 and approaches the front panel 145. Generally, the pawl 161 avoids contact with the front panel 145 in order for the belt member 105 to more easily slide past the pawl 161 as the user inserts the second end 102 of the belt member 105 through the second adjustment element 125. In some embodiments, a magnet 169 can be coupled to the region of the inner span 155. The magnet 169 can be held within an outer covering configured to couple the magnet 169 to the inner span 155. The inner span 155 can include a slot 151 or other feature through which at least a portion of the magnet 169 can be available through the span 155 from within the channel 160.

When the plate element 159 is in the closed position, the pawl 161 can engage with teeth 109 of the belt member 105. As mentioned above, the teeth 109 can have a ramped portion facing the second end 102 of belt member 105 and a stepped portion perpendicular to the longitudinal axis of the belt member 105. As the belt member 105 inserts through the channel 160 in a first, tightening direction away from the second end 102, the pawl 161 can slide past the ramped portion of the teeth 109 with little to no resistance. The belt member 105 can be prevented from moving in an opposite, loosening direction towards the second end 102 due to the pawl 161 engaging and abutting against the stepped portion of the teeth 109. Engagement between the teeth 109 of the belt member 105 and the pawl 161 of the second adjustment element 125 provide for more fine adjustment in tightness and looseness of the belt system 100 around a user's waist.

The plate element 159 can be toggled to the open position in which the pawl 161 is pulled out of engagement with teeth 109 of the belt member 105. The pin element 157 can be coupled to an actuation button 167 at one end. Pressure applied by a user against the actuation button 167 can rotate the pin element 157 and the attached plate element 159 around the longitudinal axis of the pin element 157. As the pin element 157 and the plate element 159 pivot, tab 163 is drawn away from magnet 169 of the inner span 155 and pawl 161 rotates away from front panel 145 and approaches a plane that is parallel to the plane of the front panel 145 and the longitudinal axis of the channel 160. The pawl 161 is removed from the channel 160 away from engagement with teeth 109 such that the belt member 105 can be pulled in either direction through the second adjustment element 125. Releasing the actuation button 167 allows the tab 163 to be attracted back towards the magnet 169. The plate element 159 pivots back around the longitudinal axis of the pin element 157 in an opposite direction until tab 163 approaches (or contacts through slot 151) magnet 169 of the inner span 155. Pawl 161 approaches the front panel 145 and once again extends into channel 160 such that it can engage with teeth 109 of the belt member 105.

Figure 7:
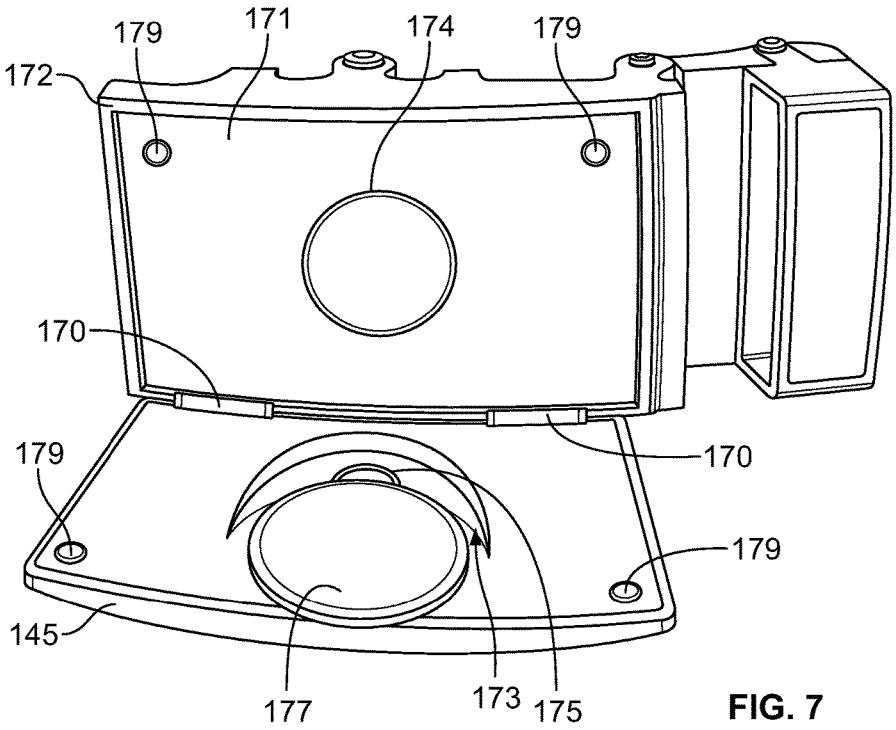
FIG. 7 illustrates a front view of an embodiment of a fixation member for a belt system in an open configuration with a golf ball marker partially inserted.
Figure 8:
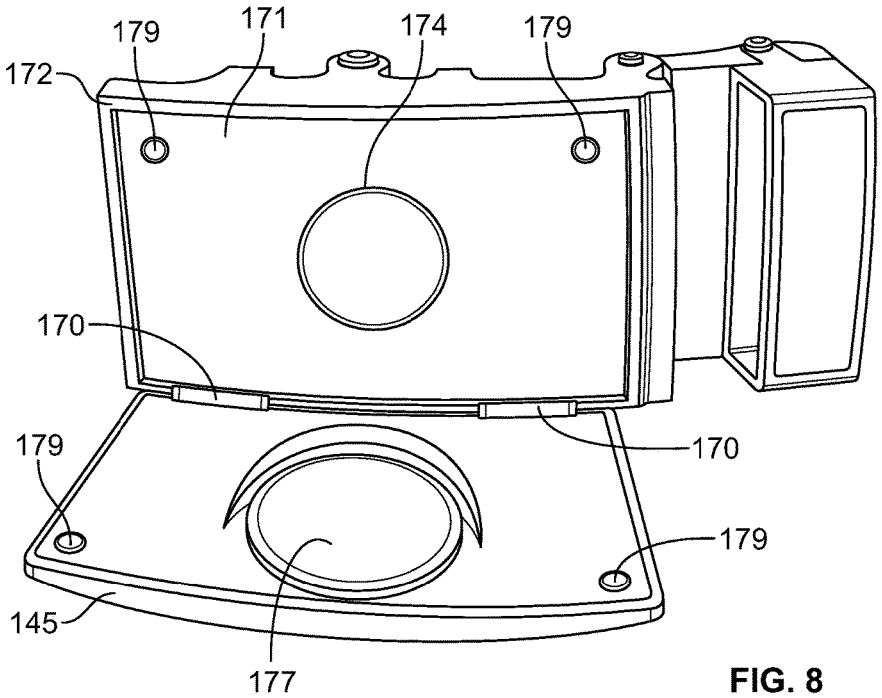
FIG. 8 illustrates a front view of the fixation member of FIG. 7 and golf ball marker.

Now with respect to FIGS. 7 and 8, the front panel 145 can be coupled to the second adjustment element 125 by one or more hinges 170. The hinges 170 can be positioned on a downward-facing side of the second adjustment element 125 such that when a user is wearing the belt system 100 the front panel 145 opens in a top-down direction. It should be appreciated that the hinges 170 can be positioned in other locations such as an upward-facing side or a side portion of the second adjustment element 125 such that the front panel 145 can swing open from a left-right direction or right-left direction. The front panel 145 can rotate about the hinges 170 to reveal an inner mating surface 171. The front panel 145 can include a grip feature to aid in opening the front panel 145 away from the inner mating surface 171. Alternatively, one or more corners 172 of the mating surface 171 can be rounded off or tapered such that a user can obtain a grip on the front panel 145 relative to the inner mating surface 171, such as by inserting a portion of a fingernail, in order to swing the front panel 145 away from the mating surface 171. The mating surface 171 can have one or more closure magnets 179 that aid in maintaining the front panel 145 in a closed position against the mating surface 171. The inner surface of the front panel 145 can also include one or more closure magnets 179 aligned with the closure magnets 179 of the mating surface 171.

The hinging front panel 145 can be used to store or conceal one or more small articles 177 within the second adjustment element 125, including but not limited to, golf ball markers, currency, business cards, keys, and other personal items. The inner surface of the front panel 145 can include a depression 173 aligned with a corresponding depression 174 in the mating surface 171. The depressions 173, 174 can be configured to accept and hold the article 177 within a space between the depressions 173, 174 and within the second adjustment element 125. In some embodiments, the article 177 is a golf ball marker as shown in FIGS. 7 and 8. The golf ball marker can be a generally round and flat metallic element that can slide into depression 173 of the front panel 145. The depression 173 of the front panel 145 can be magnetized or include a magnet 175 such that the article 177 is attracted to and maintained within the depression 173 even when the front panel 145 is swung into the open position.

Figure 9:
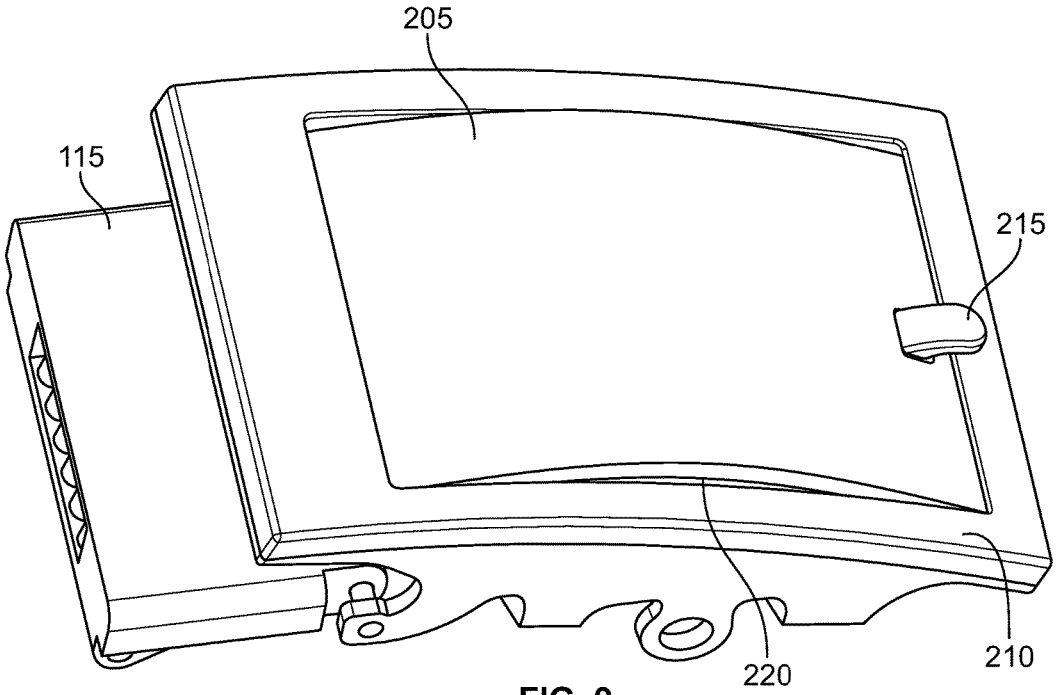
FIG. 9 illustrates a front view of another embodiment of a fixation member for a belt system.
Figure 10:
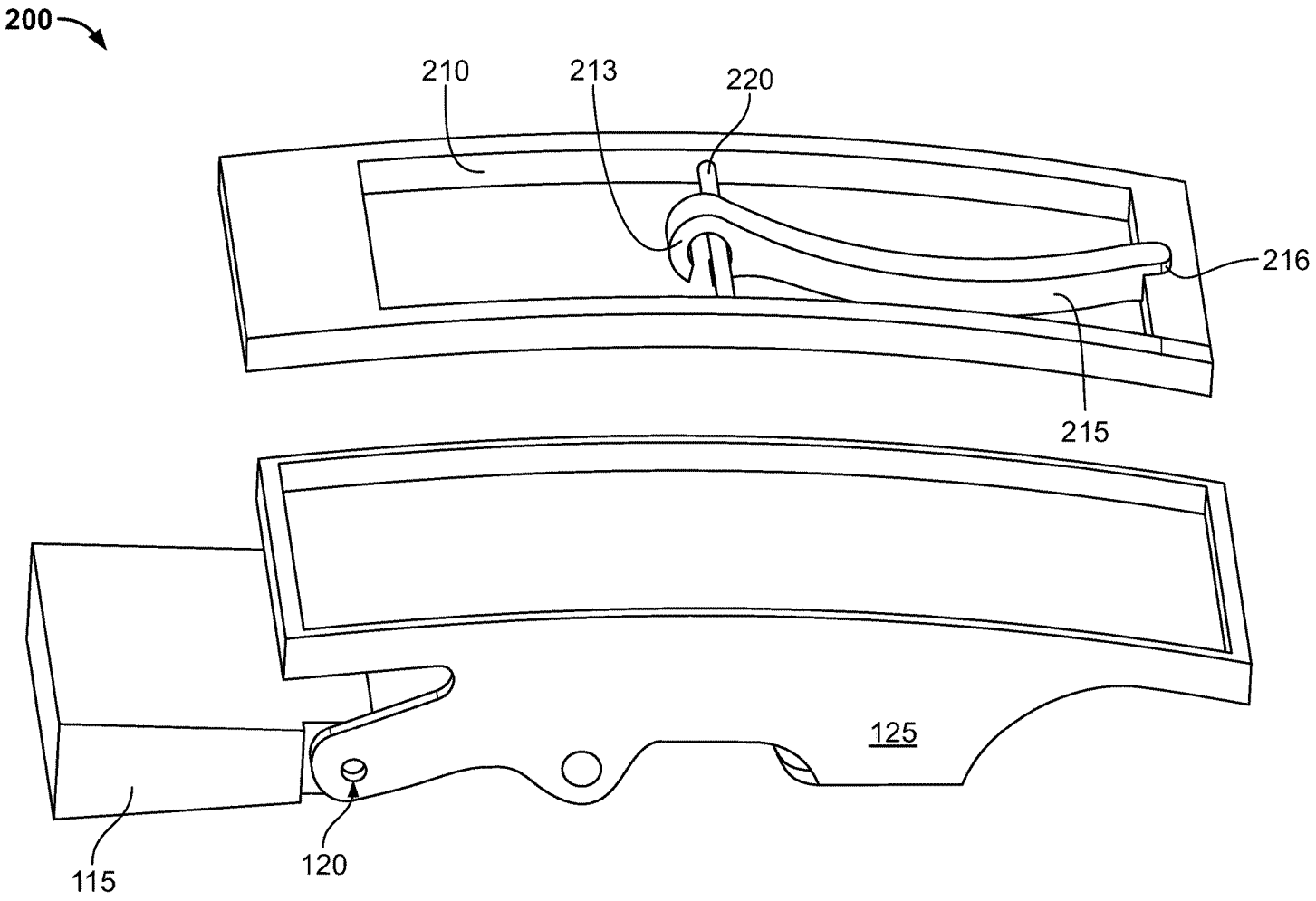
FIG. 10 illustrates a side exploded view of the fixation member of FIG. 9.
Figure 11:
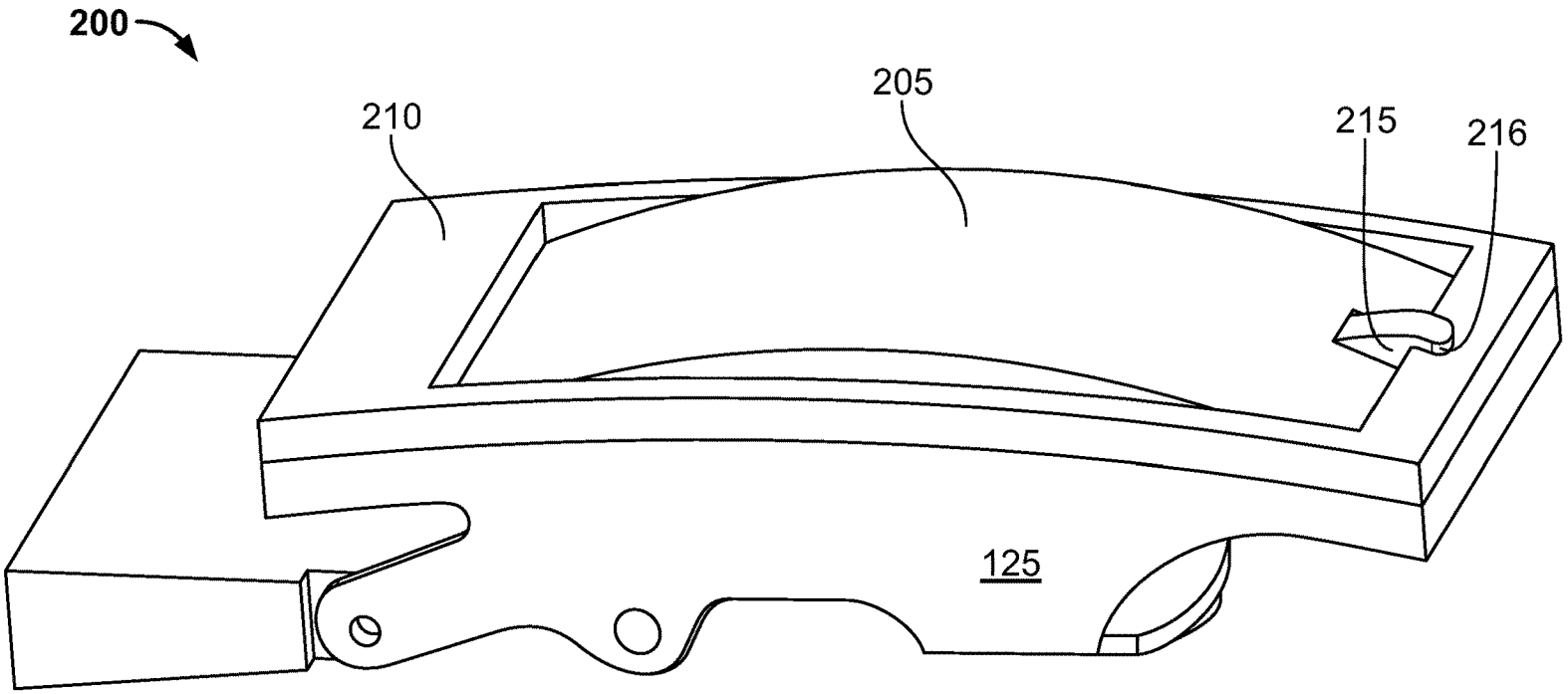
FIG. 11 illustrates a side view of the fixation member of FIG. 9.

The belt systems 100 described herein can include a belt façade 200. The belt system 100 incorporating the belt façade 200 can provide the convenience and fine adjustment fit of a ratcheting belt while maintaining the aesthetic of a traditional belt design. As shown in FIGS. 9, 10, and 11, the belt façade 200 can be coupled to an outer surface of the second adjustment element 125. The belt façade 200 can include a belt insert 205 and a frame 210. The belt insert 205 can be a portion of material matched in style to the belt member 105 to which the second adjustment element 125 is coupled. For example, the belt insert 205 can be leather, fabric, plastic or any other suitable material of the belt member 105. The frame 210 can surround the belt insert 205 at its perimeter sandwiching the belt insert 205 between the outer surface of the second adjustment element 125 and an inner surface of the frame 210. The frame 210 can include a cross pin 220 spanning between the sides of the frame 210 near a central region of the frame 210. The cross pin 220 can be configured to couple with a hook 215. The hook 215 can include an aperture 213 at one end through which the cross pin 220 can be inserted. The hook 215 can also include a flange 216 at an opposite end that can be fixed to an outer portion of the frame 210. The belt insert 205 can overlay the cross pin 220 and a majority of the hook 215 such that the cross pin 220 and hook 215 are generally hidden from view. One side of the belt insert 205 can include a notch that corresponds in shape to a portion of the hook 215 near the flange 216 such that the flange 216 atop the frame 210 is visible and resembles a hook inserted through a hole of a conventional belt.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein.

What is claimed is:

1. A method of using a belt system, the method comprising:

fixedly positioning a cut end of a belt member within a first opening of a buckle member, wherein the cut end has been cut to a desired measurement based on markings printed on a surface near a first end region of the belt member;

locating a second end of the belt member within a second opening of the buckle member; and actuating a pawl element of the buckle member so that the pawl element engages a series of teeth on the belt member and interlocks the belt member and the buckle member.

2. A method as in claim 1, wherein the desired measurement is obtained from a desired portion of a user using the belt member wherein a second end region of the belt member overlaps the first end region.

3. A method as in claim 1, wherein the markings comprise a series of graduations located on the surface near the first end region of the belt member to provide guidance for cutting.

4. A method as in claim 3, wherein the surface is an inner surface near the first end region of the belt member.

5. A method as in claim 3, wherein the desired portion of the user is a waist and the series of graduations correspond to a plurality of clothing waist sizes.

6. A method as in claim 1, wherein inserting the cut end into the first opening of the buckle member comprises engaging the cut end with a rotating plate having a plurality of teeth.

7. A method as in claim 1, wherein the belt member lacks holes.

8. A method of using a belt system, the method comprising:

positioning a first end region of a belt member within a buckle member by inserting a cut end into a first opening in the buckle member, wherein the first end region of the belt member has been cut to form the first end region using markings located on a surface near the first end region of the belt member;

affixing the cut end within the first opening of a first adjustment element; and locating a second end region of the belt member within the buckle member by sliding at least a portion of the second end region through a second opening in the buckle member.

9. A method as in claim 8, wherein the second opening extends between an outer portion coupled to an inner span having a magnetic element.

10. A method as in claim 9, wherein the buckle member comprises a belt engagement mechanism having a pivoting pin element coupled to a plate element having a pawl at a first end and a tab at a second, opposite end.

11. A method as in claim 10, wherein the plate element includes a first position in which the tab is attracted towards the magnetic element and the pawl projects into the first opening, and wherein the plate element includes a second position in which the tab is urged away from the magnetic element and the pawl rotates away from the first opening.

12. A method as in claim 11, further comprising adjusting a diameter of the belt member when worn about a user by sliding a series of teeth positioned on an inner surface of the second end region of the belt member at least partially past the pawl.

13. A method as in claim 12, wherein adjusting the diameter further comprises providing fine adjustment in tightness and looseness of the belt system around the desired portion.

14. A method as in claim 13, wherein locating the second end region of the belt member within the buckle member further comprises engaging one of the series of teeth with the pawl when the plate element is in the first position thereby preventing the belt member from moving in a loosening direction.

15. A method as in claim 14, further comprising toggling the plate element toward the second position by pulling the pawl out of engagement with the one of the series of teeth.

16. A method as in claim 14, further comprising removing the second end region of the belt member from the second opening.

17. A method as in claim 8, wherein the belt member lacks holes.

* * * * *